US011753816B2

(12) United States Patent
Marshall, III

(10) Patent No.: US 11,753,816 B2
(45) Date of Patent: Sep. 12, 2023

(54) BUILDING FOUNDATION VENTILATION SYSTEM

(71) Applicant: Your Crawl Space, Inc., McClellanville, SC (US)

(72) Inventor: Henry Bennie Marshall, III, McClellanville, SC (US)

(73) Assignee: Your Crawl Space, Inc., Awendaw, SC (US)

( * ) Notice: Subject to any disclaimer, the term of this patent is extended or adjusted under 35 U.S.C. 154(b) by 77 days.

(21) Appl. No.: 17/527,979

(22) Filed: Nov. 16, 2021

(65) Prior Publication Data

US 2022/0195720 A1 Jun. 23, 2022

Related U.S. Application Data

(60) Provisional application No. 63/128,503, filed on Dec. 21, 2020.

(51) Int. Cl.

| | |
|---|---|
| ***E04B 1/70*** | (2006.01) |
| ***F24F 7/013*** | (2006.01) |
| ***F24F 7/00*** | (2021.01) |

(52) U.S. Cl.

CPC ..... *E04B 1/7076* (2013.01); *F24F 7/013* (2013.01); *F24F 2007/0025* (2021.01)

(58) Field of Classification Search

CPC ..... F24F 7/013; F24F 2007/0025; F24F 8/70; E04B 1/7076

USPC ..... 454/276

See application file for complete search history.

(56) References Cited

U.S. PATENT DOCUMENTS

| | | | | |
|---|---|---|---|---|
| 2,665,625 A * | 1/1954 | Woodhams | B60H 1/00464 | 454/347 |
| 4,469,018 A | 9/1984 | Taulman | | |
| 4,829,882 A * | 5/1989 | Jackson | E02D 31/008 | 454/252 |
| 4,953,450 A * | 9/1990 | Remondino | F24F 7/013 | 454/343 |

(Continued)

FOREIGN PATENT DOCUMENTS

| | | | |
|---|---|---|---|
| GB | 2257246 A * | 1/1993 | F24F 7/04 |
| JP | H09217958 A * | 8/1997 | |

(Continued)

OTHER PUBLICATIONS https://www.homedepot.com/p/Tjernlund-18-in-x-4-in-x-11-in-Moisture-Mold-Reducing-UnderAire-Crawlspace-Ventilator-Fan-V4D/308439011.

*Primary Examiner* — Edelmira Bosques
*Assistant Examiner* — Frances F. Hamilton
(74) *Attorney, Agent, or Firm* — Kim and Lahey Law Firm, LLC; Seann P. Lahey

(57) ABSTRACT

A flexible cover plate with an airflow opening. A fan carried on a rear side of the cover plate over the airflow opening. A protective screen carried on a front side of the cover plate over the airflow opening. An angle bracket carried in an elongated slot disposed in said cover plate having a first portion extending parallel along the rear side of the cover plate, and a second portion extending transverse to the front side of the cover plate above the airflow opening. A flexible polymer foam sheet carried on the rear side of the cover plate for conforming to a vent opening in a building foundation wall so that an airtight seal is formed against the vent opening. A fan speed controller adjusting a desired speed of the fan and airflow through the airflow opening.

18 Claims, 7 Drawing Sheets

(56) References Cited

U.S. PATENT DOCUMENTS 5,092,520 A * 3/1992 Lestage ..... F24F 11/0001 454/343
5,131,887 A * 7/1992 Traudt ..... F24F 11/74 454/236
5,253,804 A * 10/1993 Sarazen, Jr. ..... F24F 11/0001 236/49.5
5,383,816 A * 1/1995 Marcello ..... F24F 13/10 454/363
5,482,507 A * 1/1996 Priest ..... F24F 13/075 34/235
5,564,976 A 10/1996 Muller et al.
D411,874 S 7/1999 Ko
5,944,445 A 8/1999 Montgomery
6,149,514 A * 11/2000 Maury ..... F24F 13/20 454/271
D446,317 S 8/2001 Jackson et al.
D448,489 S 9/2001 Jackson et al.
6,468,054 B1 10/2002 Anthony et al.
6,817,942 B1 11/2004 Betz
7,097,557 B2 8/2006 Kutschman
7,270,498 B1 9/2007 Albanese
D580,043 S 11/2008 Sykes
D583,042 S 12/2008 Jackson et al.
D593,193 S 5/2009 Jackson et al.
7,600,944 B1 10/2009 Keating
D607,098 S 12/2009 Sykes
7,780,509 B1 * 8/2010 Hoaks ..... F24F 13/084 454/274
7,926,539 B1 4/2011 Hurst et al.
D654,162 S 2/2012 Sykes
8,511,938 B1 8/2013 Payne et al.
9,353,569 B1 5/2016 Anderson, Jr. et al.
9,376,803 B1 6/2016 Anderson, Jr. et al.
9,758,982 B2 9/2017 Anderson, Jr. et al.
D856,505 S 8/2019 Sykes
D875,233 S 2/2020 Sykes
10,584,510 B2 3/2020 Anderson, Jr. et al.
11,609,003 B1 * 3/2023 White ..... F16L 37/105
2002/0021941 A1 2/2002 Montgomery et al.
2003/0082008 A1 5/2003 Sprengle, Sr. et al.
2005/0186900 A1 8/2005 Janesky
2008/0113606 A1 * 5/2008 Janesky ..... F24F 7/013 454/230
2008/0182503 A1 * 7/2008 Yurcak ..... F24F 7/007 454/270
2008/0236062 A1 10/2008 Bergaglio
2009/0148236 A1 6/2009 Achen
2009/0191807 A1 * 7/2009 Wood ..... E06B 9/02 454/276
2009/0239462 A1 * 9/2009 Hendricks ..... F24F 13/084 454/271
2010/0086358 A1 4/2010 Haryslak
2012/0174501 A1 7/2012 Malitsky et al.
2012/0260593 A1 10/2012 Gower, Sr. et al.
2013/0125481 A1 * 5/2013 Marshall ..... E04B 1/62 52/169.14
2013/0279986 A1 10/2013 Payne et al.
2016/0298380 A1 10/2016 Anderson, Jr. et al.
2016/0298381 A1 10/2016 Anderson, Jr. et al.
2019/0203461 A1 7/2019 Anderson et al.
2021/0017759 A1 1/2021 Sykes

FOREIGN PATENT DOCUMENTS

JP 2004156841 A * 6/2004
KR 20100079709 A * 1/2010 ..... F24F 13/14

* cited by examiner

BUILDING FOUNDATION VENTILATION SYSTEM

BACKGROUND OF THE INVENTION

1) Field of the Invention

The present invention relates to ventilation systems for use in a building foundation such as a crawl space or basement, and more particularly, to a ventilation system that utilizes speed adjustable continuous run exhaust fans mounted in a vent opening of an encapsulated crawl space wall or basement wall having an airtight seal against the vent opening walls to control a desired constant airflow through the crawl space or basement and which creates a negative air pressure within the crawl space or basement to facilitate exhausting gasses and moisture.

2) Description of Related Art

In order to reduce moisture levels and remove unwanted gasses, crawl spaces and basements may often be equipped with various types of fan units to force airflow into a crawl space or to exhaust air from within the crawl spaces or basement out though a vent opening of an exterior wall. The main issue with installing such ventilation systems involves imperfect openings in the crawl space or basement wall, excess mortar that interferes with fitment, construction variances in size and shape, human error, and the like.

Typically, a fan unit is attached to a foundation wall using fasteners such as screws. This requires various tools to level and shim the fan unit, as well as to drill and insert the screws into concrete, mortar, and brick. The fans are also carried on a rigid plate that leaves gaps between the foundation walls in and around the ventilation port opening that air can pass through, which adversely impacts performance and airflow. While such gaps can be filed with caulk and the like, the installation is more complex and less accommodating for imperfect ventilation openings. Existing systems are not designed to form airtight seals for use with an encapsulated crawl space to create a negative air pressure airflow within the crawl space or basement.

Some fan units may include insulation, such as polymer foam insulation, to assist with temperature control around the vent opening. However, these insulation foams are rigid and brittle types of foams that are easily broken or crack and will not flex and conform to a space for mounting a fan unit in a vent opening. These insulation foams are intended purely as an insulation layer and not a mounting element of any type.

Current fan units intended for use in a crawl space or basement are operatively associated with timers, humidity and/or temperature sensors. Thus, the fan units do not run continuously, but only during defined times or conditions as determined by the sensors. As such, existing ventilation systems with fan units that operate intermittently do not maintain a constant negative air pressure within the space, allowing gasses and moisture to rise into the living space above. Existing fan units also use higher CFM fans that can cause issues pulling moisture and air from places that aren't desired for an encapsulated crawl space or basement.

Accordingly, it is an object of the present invention to provide a ventilation system for a building foundation such as a crawl space or basement that includes a fan carried on a flexible cover plate with a flexible polymer foam sheet layer on the back of the cover plate for mounting in a vent opening to hold the cover plate and fan in place such that the cover plate flexes with the foam sheet to conform to the shape of a vent opening in a crawl space or basement in an airtight arrangement for a quick and simple installation.

It is a further object of the present invention to provide a ventilation system that uses a fan unit with a low CFM fan that operates continuously and quietly to maintain a negative air pressure airflow in an encapsulated crawl space or basement.

SUMMARY OF THE INVENTION

The above objectives are accomplished according to the present invention by providing a ventilation system for a building foundation comprising a flexible cover plate; an airflow opening disposed in the cover plate; a fan carried on a rear side of the flexible cover plate, wherein the fan is adjacent to and covers the airflow opening for direct air through the airflow opening; a flexible polymer foam sheet carried on the rear side of the flexible cover plate and having a fan opening receiving the fan; wherein a perimeter of the fan is fully surrounded and engaged by the flexible polymer foam sheet forming an airtight seal between the fan and the flexible polymer foam sheet; wherein a perimeter edge of the flexible polymer foam sheet compresses against and conforms to interior wall surfaces within a vent opening in a building foundation to form an airtight seal against the interior wall surfaces; and, wherein the flexible cover plate flexes with the flexible polymer foam sheet when mounting in the vent opening to facilitate conforming and sealing the flexible polymer foam sheet within the vent opening so that the flexible cover plate is secured over the vent opening.

In a further advantageous embodiment, the flexible cover plate is selected from the group consisting of acrylonitrile butadiene styrene (ABS), polylactide (PLA), nylon, acrylic, phenolic, polyester, polyester terephthalate (PET), polyethylene, polypropylene, polycarbonate, polyacetal resin (POM), polytetrafluoroethylene (PTFE), high density polyethylene (HDPE), silicone, polyurethane, polyvinyl chloride (PVC), silicone rubber, isoprene rubber, thermoplastic elastomers, polyurethane rubbers, and combinations thereof.

In a further advantageous embodiment, the flexible cover plate preferably comprises acrylonitrile butadiene styrene (ABS).

In a further advantageous embodiment, an elongated slot is disposed in the flexible cover plate above the airflow opening and extending horizontally across the flexible cover plate at least equal to the diameter of the airflow opening.

In a further advantageous embodiment, an angle bracket is carried in the elongated slot having a first portion extending parallel along the rear side of the flexible cover plate, and a second portion extending transverse to a front side of the flexible cover plate above the airflow opening to protect the airflow opening from water and debris.

In a further advantageous embodiment, a protective screen is carried on a front side of the flexible cover plate covering over the airflow opening to protect the fan on the rear side of the flexible cover plate.

In a further advantageous embodiment, the flexible polymer foam sheet is selected from the group consisting of polyethylene, polypropylene, polystyrene, polyvinyl chloride (PVC), poly(methyl methacrylate) (PMMA), epoxy resin, phenolic resin, polyester, polyurethane, and combinations thereof.

In a further advantageous embodiment, the flexible polymer foam sheet preferably comprises a polyethylene foam having a closed cell structure on a front surface and a rear surface, and an open cell structure around the perimeter edge.

In a further advantageous embodiment, the flexible cover plate includes a flange portion extending beyond a perimeter edge on all sides of the flexible polymer foam sheet, wherein the flange portion engages an exterior wall surface surrounding the vent opening when the flexible polymer foam sheet is mounted within the vent opening.

In a further advantageous embodiment, an adhesive is disposed on the flange portion when mounted over the vent opening for sealing and bonding the flexible cover plate to the exterior wall surface surrounding the vent opening walls.

In a further advantageous embodiment, a series of adhesive strips are disposed on the rear side of the flexible cover plate bonding the flexible polymer foam sheet to the flexible cover plate.

In a further advantageous embodiment, an adhesive is disposed on the perimeter edge of the flexible polymer foam sheet when mounted in the vent opening for sealing and bonding the flexible polymer foam sheet to the interior wall surfaces within a vent opening.

In a further advantageous embodiment, a water discharge gap is formed in the adhesive along a bottom side of the perimeter edge of the flexible polymer foam sheet to allow any water between the flexible cover plate and flexible polymer foam sheet to exit.

In a further advantageous embodiment, a fan speed controller is operatively associated with the fan to adjust a desired speed of the fan and provide continuous operation of the fan so that the fan maintains a desired continuous airflow exhausting air from the building foundation when mounted in the vent opening.

In a further advantageous embodiment, a cord slot is disposed along the perimeter edge of the flexible polymer foam sheet receiving a control cord extending between the fan speed controller and the fan.

In a further advantageous embodiment, the control cord extends from the fan speed controller through the cord slot along the perimeter edge of the flexible polymer foam sheet and between the flexible cover plate and the flexible polymer foam sheet to the fan.

The above objectives are further accomplished according to the present invention by providing a ventilation system for a building foundation comprising a flexible cover plate including an airflow opening; an elongated slot disposed in the flexible cover plate above the airflow opening; a fan carried on a rear side of the flexible cover plate covering the airflow opening for direct air through the airflow opening; a protective screen carried on a front side of the flexible cover plate covering the airflow opening to protect the fan; an angle bracket carried in the elongated slot having a first portion extending parallel along the rear side of the flexible cover plate, and a second portion extending transverse to the front side of the flexible cover plate above the airflow opening to protect the airflow opening; a flexible polymer foam sheet carried on the rear side of the flexible cover plate for conforming to a vent opening in a building foundation wall to mount the flexible cover plate over the vent opening and form an airtight seal against the walls defining the vent opening, and wherein a perimeter of the fan is fully surrounded and engaged by the flexible polymer foam sheet in an airtight arrangement; and, a fan speed controller operatively associated with the fan to adjust a desired speed of the fan and provide continuous operation of the fan so that the fan maintains a desired continuous airflow exhausting air from the building foundation when mounted in the vent opening.

The above objectives are further accomplished according to the present invention by providing a ventilation system for a building foundation comprising an encapsulated foundation space; a series of vent openings in the encapsulated foundation space; a flexible cover plate disposed over each of the vent openings; an airflow opening disposed in each of the cover plates; a fan carried on a rear side of each of the flexible cover plates, wherein the fan is adjacent to and covers the airflow opening for direct air through the airflow opening; a flexible polymer foam sheet carried on the rear side of each of the flexible cover plates and having a fan opening receiving the fan; wherein a perimeter of the fan is fully surrounded and engaged by the flexible polymer foam sheet forming an airtight seal between the fan and the flexible polymer foam sheet; wherein a perimeter edge of the flexible polymer foam sheet compresses against and conforms to interior wall surfaces within each of the vent openings to form an airtight seal against the interior wall surfaces; wherein the flexible cover plate flexes with the flexible polymer foam sheet when mounting in the vent openings to facilitate conforming and sealing the flexible polymer foam sheet within each of the vent openings so that the flexible cover plate is secured over the vent openings; and, a fan speed controller operatively associated with each of the fans to adjust a desired speed of each the fan on each flexible cover plate and provide continuous operation of the fans so that the fans maintains a desired continuous airflow exhausting air from the foundation space to create and maintain a negative air pressure within the foundation space.

BRIEF DESCRIPTION OF THE DRAWINGS

The system designed to carry out the invention will hereinafter be described, together with other features thereof. The invention will be more readily understood from a reading of the following specification and by reference to the accompanying drawings forming a part thereof, wherein an example of the invention is shown and wherein.

Figure 1:
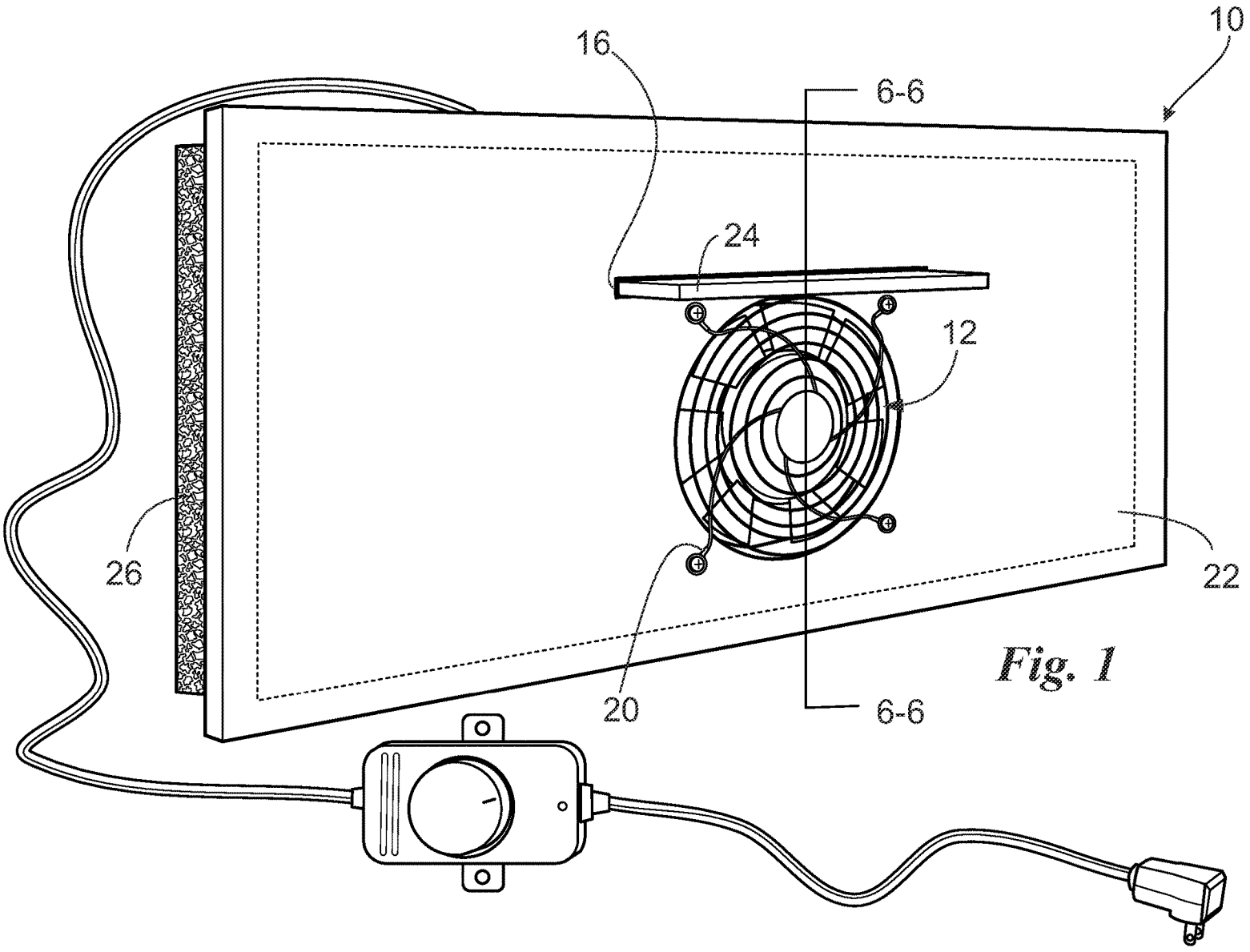
FIG. 1 shows a front perspective view of the ventilation system according to the present invention.

It will be understood by those skilled in the art that one or more aspects of this invention can meet certain objectives, while one or more other aspects can meet certain other objectives. Each objective may not apply equally, in all its respects, to every aspect of this invention. As such, the preceding objects can be viewed in the alternative with respect to any one aspect of this invention. These and other objects and features of the invention will become more fully apparent when the following detailed description is read in conjunction with the accompanying figures and examples. However, it is to be understood that both the foregoing summary of the invention and the following detailed description are of a preferred embodiment and not restrictive of the invention or other alternate embodiments of the invention. In particular, while the invention is described herein with reference to a number of specific embodiments, it will be appreciated that the description is illustrative of the invention and is not constructed as limiting of the invention. Various modifications and applications may occur to those who are skilled in the art, without departing from the spirit and the scope of the invention, as described by the appended claims. Likewise, other objects, features, benefits and advantages of the present invention will be apparent from this summary and certain embodiments described below, and will be readily apparent to those skilled in the art. Such objects, features, benefits and advantages will be apparent from the above in conjunction with the accompanying examples, data, figures and all reasonable inferences to be drawn therefrom, alone or with consideration of the references incorporated herein.

DETAILED DESCRIPTION OF A PREFERRED EMBODIMENT

With reference to the drawings, the invention will now be described in more detail. Unless defined otherwise, all technical and scientific terms used herein have the same meaning as commonly understood to one of ordinary skill in the art to which the presently disclosed subject matter belongs. Although any methods, devices, and materials similar or equivalent to those described herein can be used in the practice or testing of the presently disclosed subject matter, representative methods, devices, and materials are herein described.

Unless specifically stated, terms and phrases used in this document, and variations thereof, unless otherwise expressly stated, should be construed as open ended as opposed to limiting. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise.

Furthermore, although items, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

As shown in FIGS. 1-7, a ventilation system for a building foundation, such as a crawl space or basement, is shown for use in a vent opening for removing moisture and gasses from basements and crawl spaces. The ventilation system of the present invention is intended primarily for use in closed or sealed crawl spaces and basements, also called encapsulated spaces.

Figure 4:
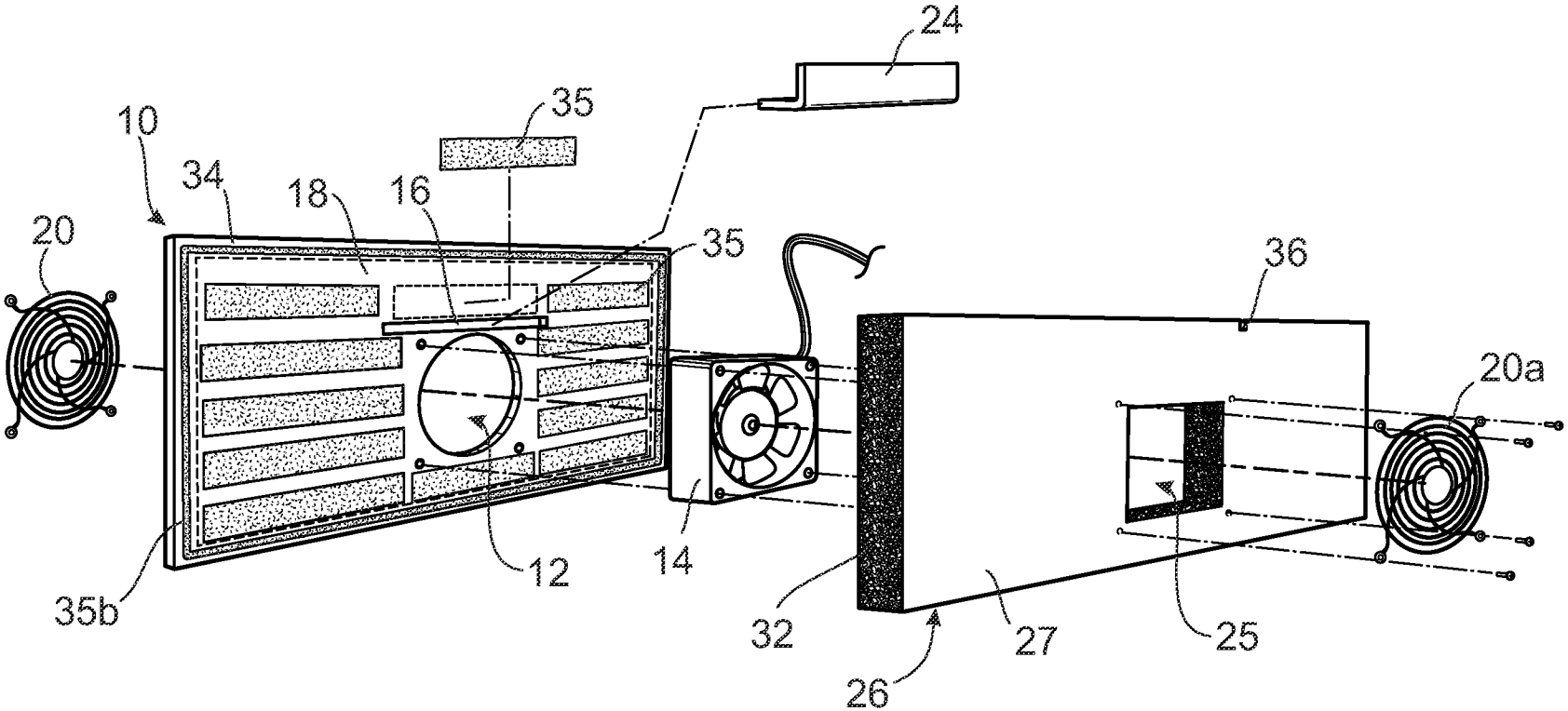
FIG. 4 shows an exploded rear perspective view of the ventilation system according to the present invention.
Figure 5:
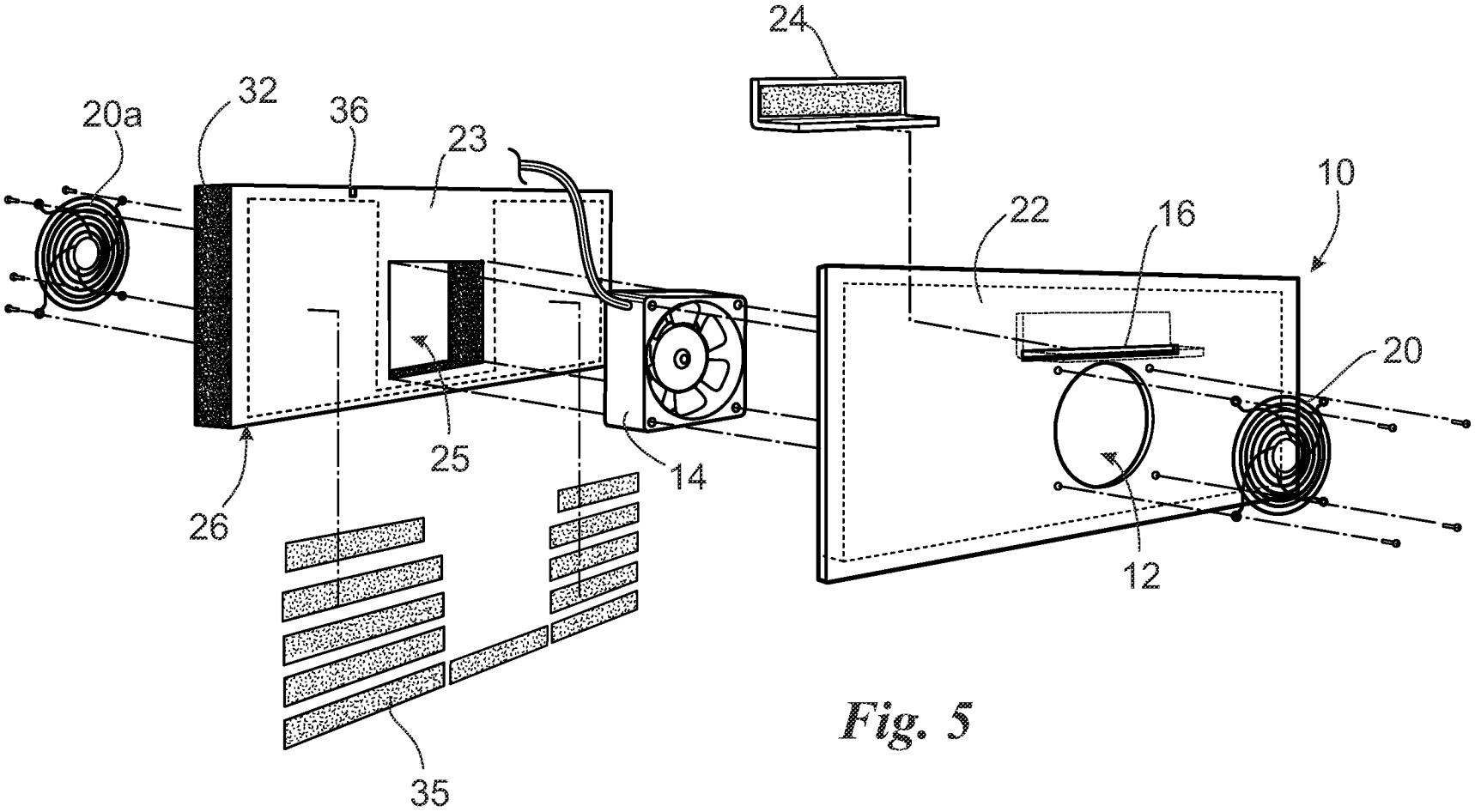
FIG. 5 shows an exploded front perspective view of the ventilation system according to the present invention.

Referring to FIGS. 1, 4 and 5, in the illustrated embodiment, the ventilation system includes a flexible cover plate 10 having an airflow opening 12. In one embodiment, flexible cover plate 10 is preferably comprised of an acrylonitrile butadiene styrene (ABS) plastic that is capable of bending and flexing during installation to accommodate variations in the shape of the vent opening area. Other materials to use for the cover plate include, but are not limited to, polylactide (PLA), nylon, acrylic, phenolic, polyester, polyester terephthalate (PET), polyethylene, polypropylene, polycarbonate, polyacetal resin (POM), polytetrafluoroethylene (PTFE), high density polyethylene (HDPE), silicone, polyurethane, polyvinyl chloride (PVC), silicone rubber, isoprene rubber, thermoplastic elastomers, polyurethane rubbers, and combinations thereof.

Referring to FIGS. 2-5, a fan 14 is carried on a rear side 18 of flexible cover plate 10 adjacent to and covering over airflow opening 12 for direct air through the airflow opening 12. While the illustrated embodiment depicts a single fan 14 arrangement for mounting on flexible cover plate 10, the mounting of multiple fans is also contemplated depending on the desired airflow characteristics. Fan 14 is designed to meet ICC building code for encapsulated, sealed, closed crawl spaces with mechanical exhaust ventilation at a rate of 1 cfm per 50 sq foot of crawl space. This is difficult to achieve with only one fan to satisfy a 1200 sf space to a 3500 sf space. Thus, the ventilation system of the present invention may comprise multiple fans mounted to various vent openings in the crawl space or basement walls. However, it is important not to move to much air to prevent pulling unwanted air into the crawl space or basement, such as from the living space above. Thus, the ventilation system of the present invention uses a variable speed low CFM fan 14 with an airtight mounting arrangement in the vent opening to adjust and control a desired amount of airflow within the encapsulated crawl space to meet ICC building code. It is important to have the ventilation system maintain an airtight seal in the vent opening to create a negative air pressure airflow within the crawl space or basement during operation as the fans 14 only exhaust air from the encapsulated crawl space.

In a preferred embodiment, fan 14 is a continuous run axial fan that is not controlled by temperature or humidity sensors, but rather operates continuously around the clock to blow air out of to produce and maintain a negative air pressure airflow within the crawl space or basement. This is needed to reverse the stack effect, where air moves from bottom to top to reduce bad air in voids of the home, wire penetrations, plumbing, wall openings, etc. as these voids can have mold, dead bugs, smells. By reversing this standard airflow to a top to bottom direction, all areas within the space are exhausted. The other benefit is to draw some minor amount of air from the living space to and thru the crawl space or basement. This will assist in equalizing air temp and humidity in the house and crawl space or basement and will extend the life of any dehumidifier by assisting with conditioning air within the crawl space.

Figure 2:
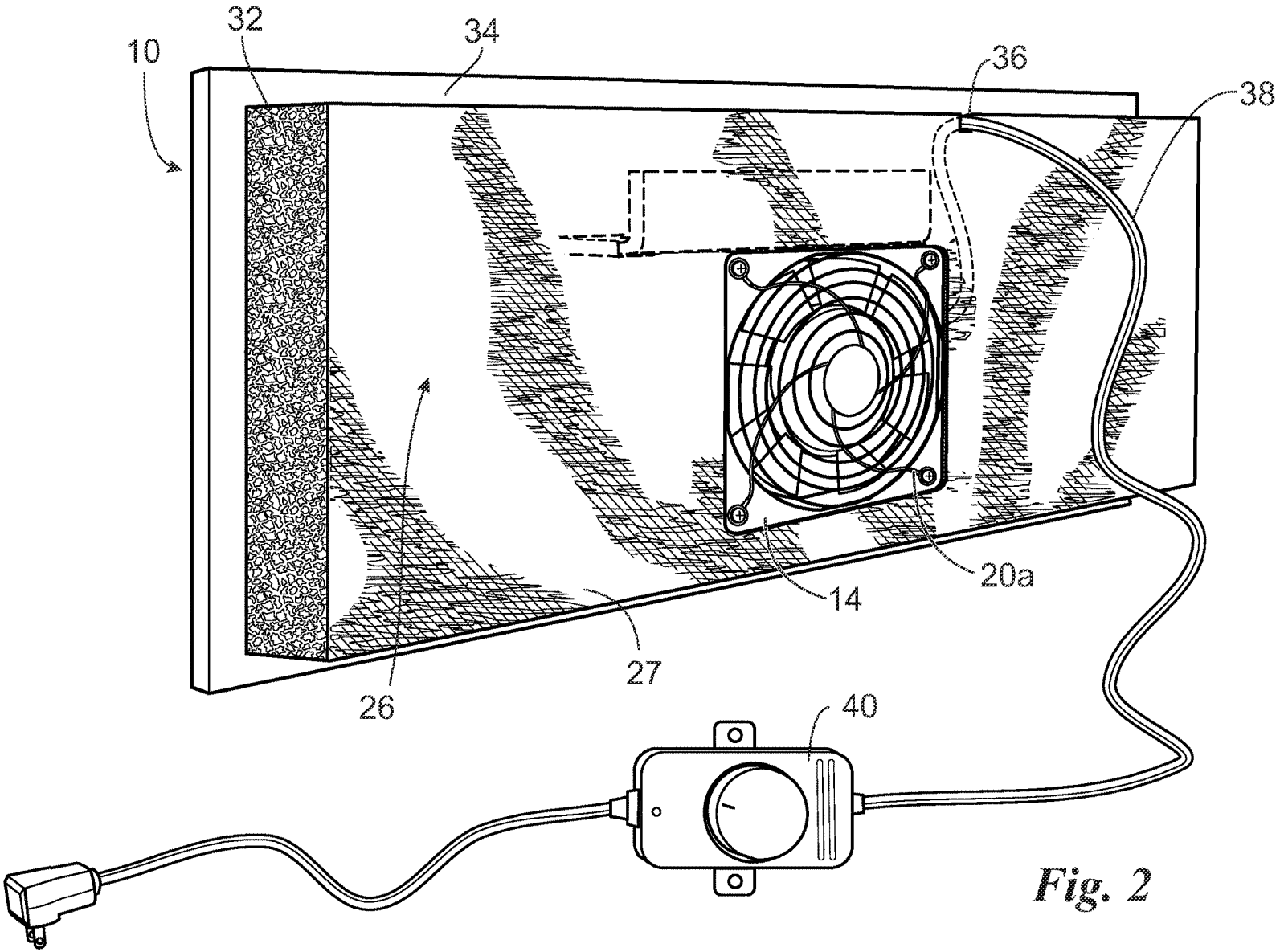
FIG. 2 shows a rear perspective view of the ventilation system according to the present invention.
Figure 3:
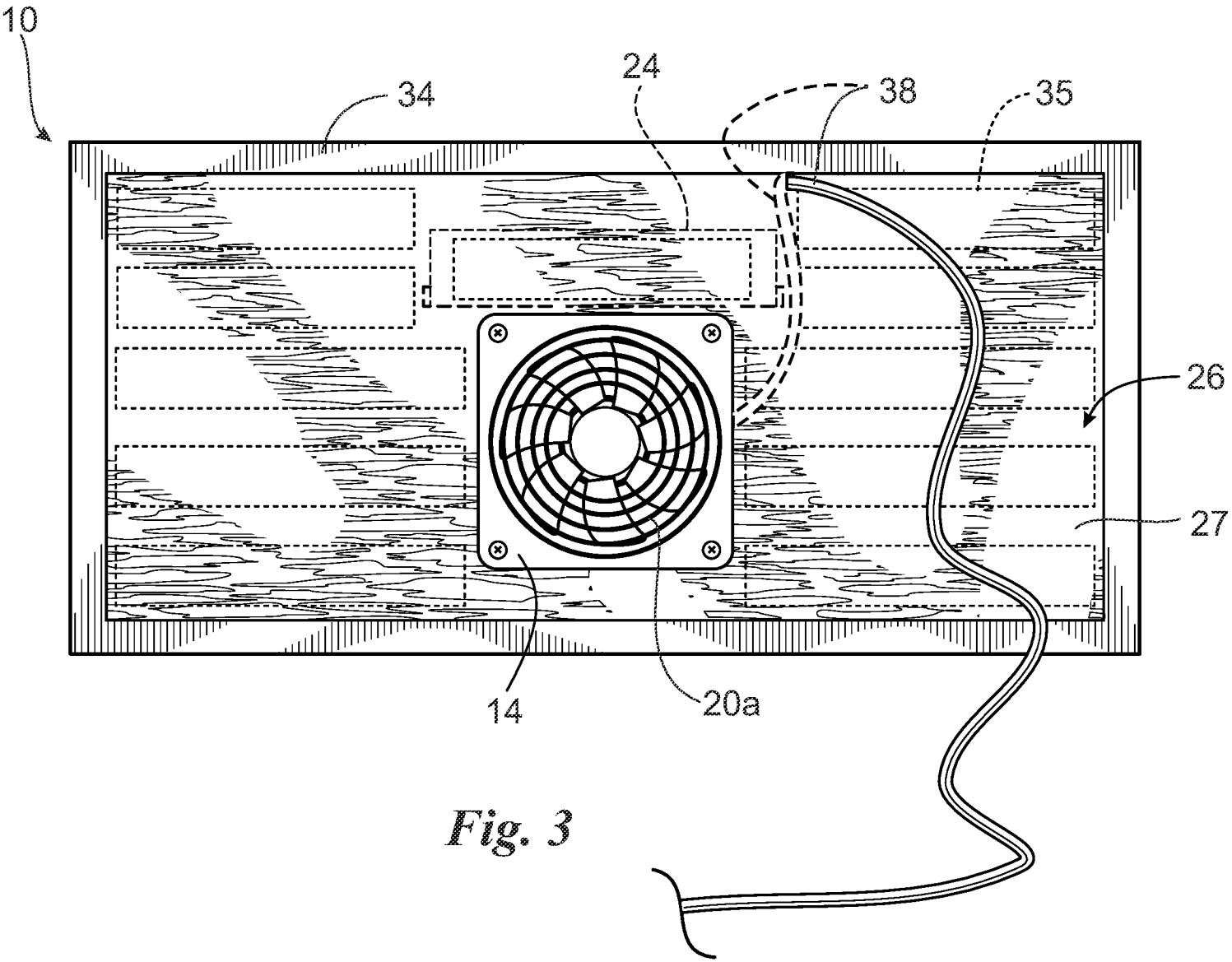
FIG. 3 shows a rear elevation view of the ventilation system according to the present invention.

Referring to FIGS. 1 and 5, in the illustrated embodiment, a protective screen 20 is carried on a front side 22 of flexible cover plate 10 covering over the airflow opening 12 to protect the fan 14 mounted to rear side 18. Referring to FIGS. 2-4, a protective screen **20*a* can also be included on the opposite side of fan 14 on the rear side 27 of flexible polymer sheet 26 so that the fan 14** is protected from both sides.

Referring to FIGS. 4 and 5, flexible cover plate 10 preferably includes an elongated slot 16 disposed above said airflow opening 12. Elongated slot 16 extends horizontally across and at least equal to the diameter of airflow opening 12. In the illustrated embodiment, elongated slot 16 extends beyond the diameter of airflow opening 12 for additional coverage over airflow opening 12. In the illustrated embodiment, elongated slot 16 is approximately 6" long by ⅛ wide, while airflow opening 12 has a diameter of approximately 4½".

Figure 6B:
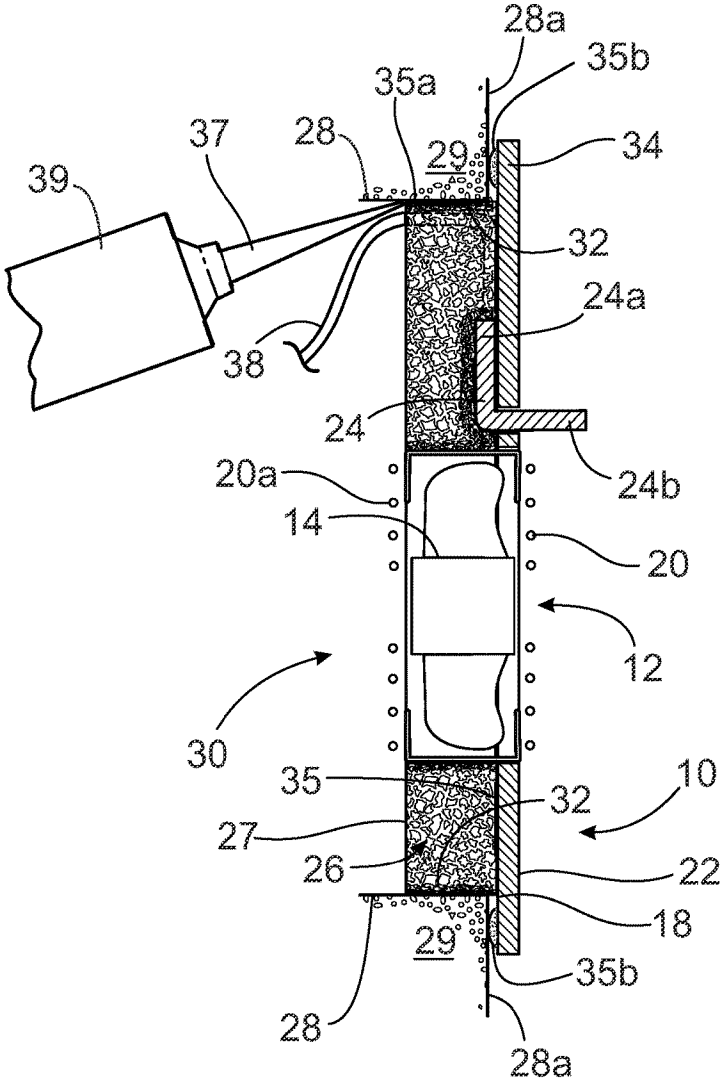
FIG. 6B shows a cross-section view of ventilation system mounted in a vent opening according to the present invention; and, FIG. 7 show a rear elevation view of the ventilation system mounted in a vent opening according to the present invention.
Figure 6A:
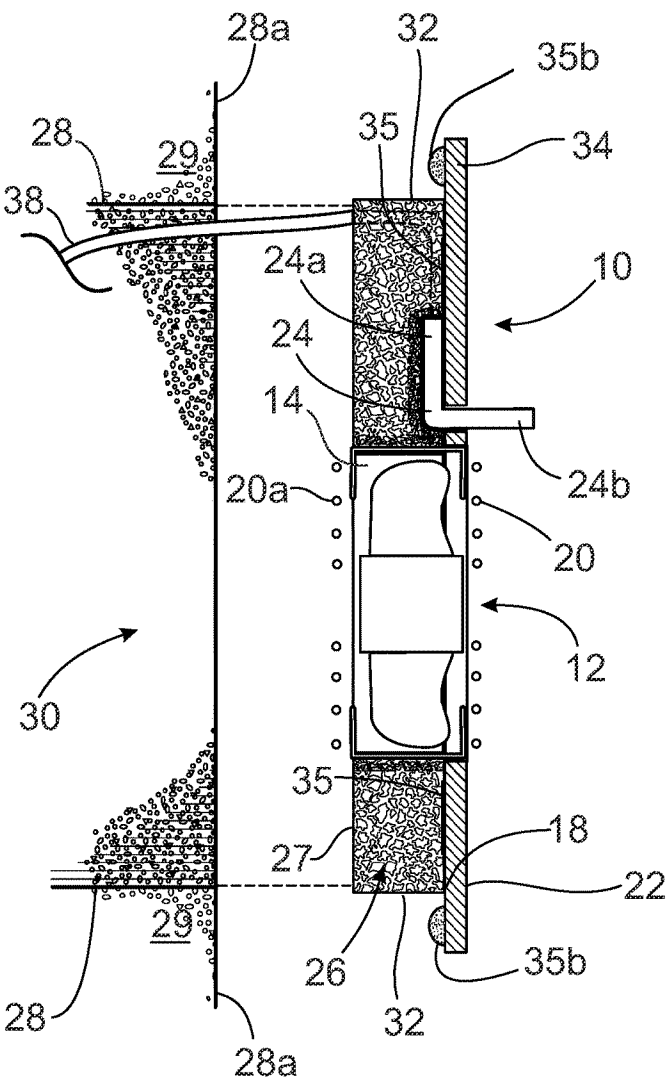
FIG. 6A shows a cross-section view of ventilation system prior to mounting in a vent opening according to the present invention.

Referring to FIGS. 1, 4 and 5, an angle bracket 24 is carried in elongated slot 16. As best shown in FIGS. 6A and 6B, angle bracket 24 includes a first portion 24*a* extending parallel along rear side 18 of flexible cover plate 10. Angle bracket 24 further includes a second portion 24*b* extending transverse to front side 22 of flexible cover plate 10 above airflow opening 12 to protect the exterior side of the airflow opening. In one embodiment, second portion 24*b* can include a downward angle to help protect the fan by allowing rain, snow and other debris to run down the face of the second portion 24*b* and away from airflow opening 12. The generally "L" shape of the angle bracket 24 helps provide stability and strength to the overhanging second portion 24*b* to resist bending and breaking.

Referring to FIGS. 1-5, a flexible polymer foam sheet 26 is carried across most of the rear side 18 of flexible cover plate 10. As best shown in FIGS. 6A and 6B, flexible polymer foam sheet 26 compresses against and conforms to interior wall surfaces 28 of a vent opening, designed generally as 30, in a crawl space or basement wall 29 so that an airtight seal is formed against the walls 29 defining the vent opening 30. As best shown in FIGS. 4 and 5, flexible polymer foam sheet 26 includes a fan opening 25 receiving fan 14. In a preferred embodiment, flexible polymer foam sheet 26 comprises a polyethylene foam sheet. Polyethylene foam is flexible, trimmable, waterproof, and UV resistant. Other flexible types of polymer foam sheets are also contemplated within the scope of the present invention so long as they are able to conform to and form an airtight seal against the walls of the vent opening while providing support for the fan 14 and flexible cover plate 10. Suitable materials for the flexible polymer foam sheet can include polypropylene, polystyrene, polyvinyl chloride (PVC), poly (methyl methacrylate) (PMMA), epoxy resin, phenolic resin, polyester, polyurethane, and combinations thereof, so long as the material is constructed and arranged to be flexible, compressible and conforming in nature.

Referring to FIGS. 2, 3, 6A and 6B, in the illustrated embodiment, a perimeter of fan 14 is fully surrounded and engaged by foam sheet 26 so the fan perimeter is encased in an airtight arrangement with foam sheet 26. By recessing the fan in the foam sheet 26, it reduces vibration, and protects the fan from excess temperatures and weather. Preferably, the fan opening 25 in foam sheet 26 receiving fan 14 is slightly smaller than the size of the fan 14 so that the flexible polymer foam sheet 26 squeezes against fan 14 to hold the fan in place and form an airtight seal with the fan perimeter to avoid any unwanted air leaks other than through airflow opening 12.

As noted above, the main issue with installing such ventilation systems involves imperfect vent openings 30 in the crawl space or basement walls 29, excess mortar that interferes with fitment, construction variances in size and shape, human error, etc. The flexible polymer foam sheet 26 allows for mounting in rough and irregular shaped openings by compressing and conforming to imperfections in the interior wall surface 28 of the vent opening 30 to form an airtight seal against the walls 29 defining the vent opening 30. Thus, no screws or drilling are needed to mount the ventilation system of the present invention in the vent opening 30. The flexible polymer foam sheet 26 has sufficient friction engagement to hold the fan 14 and cover plate 10 in place in the vent opening 30. Also, flexible cover plate 10 bends and flexes with foam sheet 26 to facilitate conforming and sealing of the flexible polymer foam sheet 26 in the vent opening 30. Thus, foam sheet 26 is squeezed into and seals against the interior surface 28 of the vent opening 30 for mounting the ventilation system to the wall 29. Accordingly, foam sheet 26 provides many benefits including an insulation layer that forms an airtight mounting within the vent opening 30 to install the fan 14, helps to quiet the fan, installs easily without the need to drill holes for screws, is water proof, UV resistant, stabilizes flexible cover plate 10 in the vent opening 30, reduces any vibrations, can easily be trimmed for odd sizes, and does not crack or break like other insulation and rigid foams. This design helps contractors reduce labor installation time.

Referring to FIGS. 3-5, in the illustrated embodiment, a series of adhesive strips 35 are disposed on rear side 18 of flexible cover plate 10 which bond the flexible polymer foam sheet 26 to flexible cover plate 10. In the preferred embodiment, the adhesive 35 is specific to adhering polyethylene as many adhesives will not produce a sufficient bond with polyethylene.

Referring to FIGS. 6A and 6B, in a further embodiment, an adhesive 35*a* is optionally included on perimeter edge 32 around the perimeter of foam sheet 26 for a more permanent installation, as well as further sealing and bonding of the flexible polymer foam sheet 26 to the wall surface 28 to maintain an airtight seal. To apply the adhesive, the flexible polymer foam sheet 26 is first installed in the vent opening 30, and then a nozzle 37 from the adhesive dispenser 39 is inserted between the foam sheet 26 and wall surface 28 and moved around perimeter edge 32 to apply the adhesive 35*a* or other sealant. The perimeter edge 32 deforms as the nozzle is inserted and moved across a given area. The foam sheet 26 then recompress against the wall after the adhesive 35*a* is applied and the nozzle removed. In the preferred embodiment, the adhesive 35*a* is also specific to adhering polyethylene as many adhesives will not produce a sufficient bond with polyethylene.

In a preferred embodiment, flexible polymer foam sheet 26 is a polyethylene foam having a closed cell structure on a front surface 23 and rear surface 27, and an open cell structure around perimeter edge 32. This allows the adhesive 35*a* when applied to the open cell structure of perimeter edge 32 to penetrate deeper into the perimeter edge 32 for creating a better seal and bond between foam sheet 26 and wall 29 of the vent opening 30. Optionally, adhesive 35*a* can be applied against rear surface 27 adjacent wall 29 for further sealing and bonding to wall 29.

Figure 7:
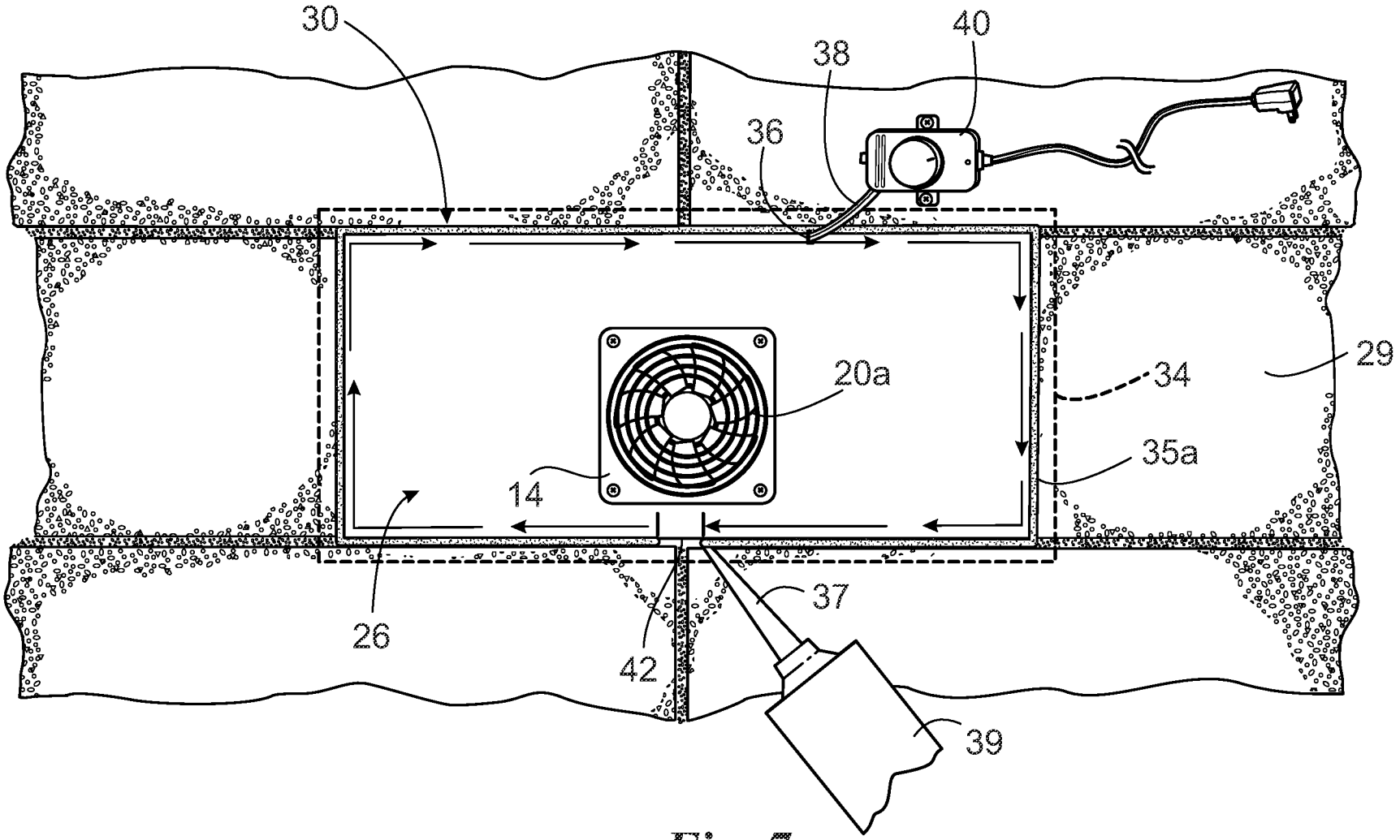

Referring to FIG. 7, in one embodiment, a water discharge gap 42 is provided in the adhesive 35*a* disposed along a bottom side of the perimeter edge 32 of foam sheet 26 below fan 14 to allow for any water to exit that may find its way past the airflow opening 12 and between flexible cover plate 10 and foam sheet 26.

Referring to FIGS. 2-4, 6A and 6B, in the illustrated embodiment, flexible cover plate 10 includes a flange portion 34 extending beyond the perimeter edge 32 of flexible polymer foam sheet 26. As best shown in FIG. 6B, the flange portion 34 engages an exterior wall surface 28*a* surrounding the vent opening 30 when the flexible polymer foam sheet 26 is mounted within the vent opening 30. Optionally, an adhesive 35*b* can also be applied to flange portion 34 of rear side 18 of flexible cover plate 10 around the foam sheet 26 to further secure and seal cover plate 10 to the exterior wall surface 28*a* without using metal screws, clamps, or shims to level and stabilize. Accordingly, flexible foam sheet 26 forms a tight seal to prevent air from leaking around the sides of the vent cover plate 10 to maintain a desired airflow and negative air pressure within the crawl space or basement. While the illustrated embodiment shows the ventilation system mounted on the exterior side of the crawl space vent opening, it may just as easily be mounted on the interior side of the vent opening from within the crawl space of basement as may be desired for a given application.

Referring to FIGS. 2, 4 and 7, a cord slot 36 is disposed in perimeter edge 32 of flexible polymer foam sheet 26 receiving a control cord 38 from fan 14. Control cord 38 passes between foam sheet 26 and flexible cover plate 10 and exits through cord slot 36. Cord slot 36 eliminates any interference of the control cord 38 between foam sheet 26 sealing against interior surface 28 of the vent opening 30.

Referring to FIGS. 2 and 7, a fan speed controller 40 is operatively associated with fan 14 through control cord 38 for adjusting a desired speed of fan 14 and airflow through airflow opening 12. One of the ICC code approved ways to condition these spaces is to provide 1 cfm of continuous ventilation per 50 square feet of basement or crawl space. This means that a different amount of airflow is needed for any given project space. To accomplish this, the fan 14 includes speed controller 40 to adjust the volume of airflow for each fan used in a vent opening 30 according to the present invention. As such, multiple fans can be adjusted individually to cooperate to maintain a negative air pressure airflow within an encapsulated crawl space or basement without excessively exhausting air and exceeding the desired 1 cfm of continuous ventilation per 50 square feet. Having the correct CFM for a given square footage is important to system efficiency, as well as having a tight seal around the vents to create a negative air pressure within the crawl space to prevent moist air from entering the crawl space or basement from around the fan 14.

While the present subject matter has been described in detail with respect to specific exemplary embodiments and methods thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art using the teachings disclosed herein.

What is claimed is:

1. A ventilation system for a building foundation comprising:

a flexible cover plate;

an airflow opening disposed in said cover plate;

a fan carried on a rear side of said flexible cover plate, wherein said fan is adjacent to and covers said airflow opening for direct air through said airflow opening;

a flexible polymer foam sheet carried on said rear side of said flexible cover plate and having a fan opening receiving said fan;

wherein a perimeter of said fan is fully surrounded and engaged by said flexible polymer foam sheet forming an airtight seal between said fan and said flexible polymer foam sheet;

wherein a perimeter edge of said flexible polymer foam sheet compresses against and conforms to interior wall surfaces within a vent opening in a building foundation to form an airtight seal against said interior wall surfaces;

wherein said flexible cover plate flexes with said flexible polymer foam sheet when mounting in said vent opening to facilitate conforming and sealing said flexible polymer foam sheet within said vent opening so that said flexible cover plate is secured over said vent opening; and, wherein said flexible polymer foam sheet comprises a polyethylene foam having a closed cell structure on a front surface and a rear surface, and an open cell structure around said perimeter edge.

2. The ventilation system of claim 1 wherein said flexible cover plate is selected from the group consisting of acrylonitrile butadiene styrene (ABS), polylactide (PLA), nylon, acrylic, phenolic, polyester, polyester terephthalate (PET), polyethylene, polypropylene, polycarbonate, polyacetal resin (POM), polytetrafluoroethylene (PTFE), high density polyethylene (HDPE), silicone, polyurethane, polyvinyl chloride (PVC), silicone rubber, isoprene rubber, thermoplastic elastomers, polyurethane rubbers, and combinations thereof.

3. The ventilation system of claim 1 wherein said flexible cover plate comprises acrylonitrile butadiene styrene (ABS).

4. The ventilation system of claim 1 including an elongated slot disposed in said flexible cover plate above said airflow opening and extending horizontally across said flexible cover plate at least equal to the diameter of said airflow opening.

5. The ventilation system of claim 4 including an angle bracket carried in said elongated slot having a first portion extending parallel along said rear side of said flexible cover plate, and a second portion extending transverse to a front side of said flexible cover plate above said airflow opening to protect said airflow opening from water and debris.

6. The ventilation system of claim 1 including a protective screen carried on a front side of said flexible cover plate covering over the airflow opening to protect said fan on said rear side of said flexible cover plate.

7. The ventilation system of claim 1 wherein said flexible cover plate includes a flange portion extending beyond a perimeter edge on all sides of said flexible polymer foam sheet, wherein said flange portion engages an exterior wall surface surrounding said vent opening when said flexible polymer foam sheet is mounted within said vent opening.

8. The ventilation system of claim 7 including an adhesive disposed on said flange portion when mounted over said vent opening for sealing and bonding said flexible cover plate to said exterior wall surface surrounding said vent opening walls.

9. The ventilation system of claim 1 including a series of adhesive strips disposed on said rear side of said flexible cover plate bonding said flexible polymer foam sheet to said flexible cover plate.

10. The ventilation system of claim 1 including an adhesive disposed on said perimeter edge of said flexible polymer foam sheet when mounted in said vent opening for sealing and bonding said flexible polymer foam sheet to said interior wall surfaces within a vent opening.

11. The ventilation system of claim 1 including a water discharge gap formed in said adhesive along a bottom side of said perimeter edge of said flexible polymer foam sheet to allow any water between said flexible cover plate and flexible polymer foam sheet to exit.

12. The ventilation system of claim 1 including a fan speed controller operatively associated with said fan to adjust a desired speed of said fan and provide continuous operation of said fan so that said fan maintains a desired continuous airflow exhausting air from said crawl space when mounted in said vent opening.

13. The ventilation system of claim 12 including a cord slot disposed along said perimeter edge of said flexible polymer foam sheet receiving a control cord extending between said fan speed controller and said fan.

14. The ventilation system of claim 13 wherein said control cord extends from said fan speed controller through said cord slot along said perimeter edge of said flexible polymer foam sheet and between said flexible cover plate and said flexible polymer foam sheet to said fan.

15. A ventilation system for a building foundation comprising:

a flexible cover plate including an airflow opening;

an elongated slot disposed in said flexible cover plate above said airflow opening;

a fan carried on a rear side of said flexible cover plate covering said airflow opening for direct air through said airflow opening;

a protective screen carried on a front side of said flexible cover plate covering the airflow opening to protect said fan;

an angle bracket carried in said elongated slot having a first portion extending parallel along said rear side of said flexible cover plate, and a second portion extending transverse to said front side of said flexible cover plate above said airflow opening to protect said airflow opening;

a flexible polymer foam sheet carried on said rear side of said flexible cover plate for conforming to a vent opening in a building foundation wall to mount said flexible cover plate over said vent opening and form an airtight seal against the walls defining said vent opening, and wherein a perimeter of said fan is fully surrounded and engaged by said flexible polymer foam sheet in an airtight arrangement; and, a fan speed controller operatively associated with said fan to adjust a desired speed of said fan and provide continuous operation of said fan so that said fan maintains a desired continuous airflow exhausting air from said building foundation when mounted in said vent opening.

16. A ventilation system for a building foundation comprising:

an encapsulated foundation space;

a series of vent openings in said encapsulated foundation space;

a flexible cover plate disposed over each of said vent openings;

an airflow opening disposed in each of said cover plates;

a fan carried on a rear side of each of said flexible cover plates, wherein said fan is adjacent to and covers said airflow opening for direct air through said airflow opening;

a flexible polymer foam sheet carried on said rear side of each of said flexible cover plates and having a fan opening receiving said fan;

wherein a perimeter of said fan is fully surrounded and engaged by said flexible polymer foam sheet forming an airtight seal between said fan and said flexible polymer foam sheet;

wherein a perimeter edge of said flexible polymer foam sheet compresses against and conforms to interior wall surfaces within each of said vent openings to form an airtight seal against said interior wall surfaces;

wherein said flexible cover plate flexes with said flexible polymer foam sheet when mounting in said vent openings to facilitate conforming and sealing said flexible polymer foam sheet within each of said vent openings so that said flexible cover plate is secured over said vent openings; and, a fan speed controller operatively associated with each of said fans to adjust a desired speed of each said fan on each flexible cover plate and provide continuous operation of said fans so that said fans maintains a desired continuous airflow exhausting air from said foundation space to create and maintain a negative air pressure within said foundation space.

17. The ventilation system of claim 16 including a protective screen carried on a front side of said flexible cover plate covering over the airflow opening to protect said fan on said rear side of said flexible cover plate.

18. The ventilation system of claim 16 including an elongated slot disposed in said flexible cover plate above said airflow opening and extending horizontally across said flexible cover plate at least equal to the diameter of said airflow opening; and, an angle bracket carried in said elongated slot having a first portion extending parallel along said rear side of said flexible cover plate, and a second portion extending transverse to a front side of said flexible cover plate above said airflow opening to protect said airflow opening from water and debris.

* * * * *